US005214901A

United States Patent [19]

Milliner

[11] Patent Number: 5,214,901

[45] Date of Patent: Jun. 1, 1993

[54] APPARATUS AND METHOD FOR INSERTING A SPACER BETWEEN TWO PACKS OF CIGARETTES

[75] Inventor: Kenneth M. Milliner, Macon, Ga.

[73] Assignee: Brown & Williamson Tobacco Corp., Louisville, Ky.

[21] Appl. No.: 833,268

[22] Filed: Feb. 10, 1992

[51] Int. Cl.[5] ..... B65B 35/50; B65B 13/02; B65B 35/24

[52] U.S. Cl. ..... 53/397; 53/415; 53/447; 53/136.1; 53/157; 53/540; 53/580

[58] Field of Search ..... 53/415, 445, 447, 156, 53/157, 540, 136.1, 136.2, 397, 580

[56] References Cited

U.S. PATENT DOCUMENTS

| | | | |
|---|---|---|---|
| 3,177,630 | 4/1965 | Hänsel et al. | 53/156 X |
| 3,206,911 | 9/1965 | Carle et al. | 53/415 X |
| 3,412,843 | 11/1968 | Maulini | 53/540 X |
| 3,604,181 | 9/1969 | Adcox | 53/540 X |
| 3,681,160 | 8/1972 | Richie et al. | 53/415 X |
| 3,991,168 | 11/1976 | Richards et al. | 53/157 X |
| 4,815,251 | 3/1989 | Goodman | 53/156 X |
| 5,101,956 | 4/1992 | Gambetti | 53/540 X |

*Primary Examiner*—Horace M. Culver
*Attorney, Agent, or Firm*—Charles G. Lamb

[57] ABSTRACT

An apparatus and method for manufacturing dual cigarette packs having a spacer therebetween. The apparatus of one preferred embodiment includes: an assembly station to receive sequentially in stacked relationship a first pack of cigarettes, a spacer, and a second pack of cigarettes, the assembly station including means to transport said cigarette packs through the assembly station; means to feed cigarette packs at first and third positions along the assembly station; means to place a spacer on the cigarette packs at a second position of the assembly station, the second position being located between the first and third positions of the assembly station; and, means to place cigarette packs onto the spacer at the third position of the assembly station, thereby creating a dual cigarette pack having a spacer therebetween. One method for forming a dual cigarette pack having spacer therebetween includes the steps of: delivering a first cigarette pack to a first position of an assembly station; transporting the first cigarette pack from the first position to a second position of the assembly station; applying a spacer upon the first cigarette pack at the second position; delivering a second cigarette pack to a third position of the assembly station; and, transporting the first cigarette pack having a spacer thereupon to the third position, the cigarette pack having a spacer applied thereupon being transported beneath the second cigarette pack already delivered to the third position, thereby creating a dual cigarette pack having a spacer therebetween.

10 Claims, 6 Drawing Sheets

APPARATUS AND METHOD FOR INSERTING A SPACER BETWEEN TWO PACKS OF CIGARETTES

BACKGROUND OF THE INVENTION

The present invention relates to an apparatus and method for inserting a spacer between two packs of cigarettes. The dual packs having a spacer therebetween can then be banded together. This invention is particularly useful with the non-traditional reduced circumference cigarettes, which are often called "slim", "slims", "super slim", or "super slims" cigarettes (hereinafter all referred to as "slim cigarettes"), wherein the packs of twenty smaller circumference cigarettes are not as thick as a standard pack of twenty cigarettes. By inserting a spacer between two packs of the slim cigarettes and banding the two packs together, the slim cigarettes packs can be inserted into cartons having the same thickness as those used for packaging the standard sized cigarette packs. This permits the same cartoning and casing machines to be used in manufacturing standard sized cigarettes, as well as those cigarettes having a reduced circumference.

(b) Description of the Prior Art

Since starting to manufacture and market reduced circumference cigarette products, the tobacco industry has developed ways to package the reduced circumference cigarettes utilizing the same dimensioned cartons and cases used for standard sized cigarettes. For example, with the "CAPRI" brand cigarette product, the Brown and Williamson Tobacco Corporation utilizes three spacers in a carton. One spacer is inserted between two five pack parallel row of cigarette packages and the other two are inserted on opposite sides of the carton between the packs and the inner walls of the carton. The three spacers are sized s that the thickness of two packs of "CAPRI" brand cigarettes and the three spacers approximate the thickness of two standard cigarette packs. By notching the spacers, the carton for the "CAPRI" brand product is designed to permit easy removal of each pack of cigarettes. In contrast, the present invention inserts one spacer between two packs and bands the packs together, therefore, being designed to use standard cartons for slim cigarettes which are packaged to sell in packs of two.

The prior art teaches, for example, in U.S. Pat. No. 1,939,500 a cigarette packaging machine for inserting a card or picture between two rows of cigarettes before the cigarettes are put in a pack.

Moreover, U.S. Pat. No. 2,456,059 teaches a machine for banding two cartons together. The machine includes a first set of conveyor belts including a lower belt conveyor and an upper belt conveyor with guide plates located adjacent the opposite sides of the space between the two belt conveyors, and a second set of conveyor belt including a lower belt conveyor and an upper belt conveyor in end-to-end alignment with the first set of conveyor belts. A band applicator is positioned between the first set of conveyor belts and the second set of conveyor belts.

Furthermore, U.S. Pat. No. 3,125,840 teaches a brick packaging apparatus for placing separators between adjacent bricks which are to be secured together in groups; U.S. Pat. No. 3,585,777 teaches a machine for grouping articles together and packaging then with shrink wrap; U.S. Pat. No. 4,054,020 teaches an apparatus for inserting a spacer panel between adjacent articles such as cigarette packages by means of a pair of movable spring loaded fingers which contact the tip sides of adjacent cigarette packages and tips them away from each other so that a spacer can drop by gravity downwardly for between the fingers into the space between adjacent cigarette packages; and, U.S. Pat. No. 4,086,744 teaches an apparatus for re-orienting cigarette packages as that sealing strips or tax stamps can be placed on each package.

SUMMARY OF THE INVENTION

The present invention is for an apparatus and method for inserting a spacer between two packs of cigarettes. The dual packs having a spacer therebetween can then be banded together by application of a label. Cigarette packs from a single source are fed by two belt conveyors to two positions of an assembly station which collects and collates the packs and a spacer fed to a position of the assembly station between the two cigarette pack positions.

More particularly, the present invention comprises an apparatus which feeds cigarette packs from a chute onto a conveyor belt which continuously feeds a chain conveyor at one location. The conveyor belt also supplies packs to another conveyor belt by an index lug belt. For every four packs transported by the chain conveyor, the index lug belt takes away four packs for the other conveyor belt, which then also continuously feeds the chain conveyor, but at a different location. The chain conveyor sequentially collects one pack, one spacer, and a second pack in proper orientation to apply a label or band.

Even more particularly, the present invention comprises an apparatus for manufacturing dual cigarette packs having a spacer therebetween, comprising: an assembly station to receive sequentially in stacked relationship a first pack of cigarettes, a spacer, and a second pack of cigarettes, said assembly station including means to transport said cigarette packs through said assembly station; means to feed cigarette packs at first and third positions along said assembly station; means to place a spacer on said cigarette packs at a second position of said assembly station, said second position being located between said first and third positions of said assembly station; and, means to place one cigarette pack onto said spacer at said third position of said assembly station, thereby creating a dual cigarette pack having a spacer therebetween.

Finally, the present invention comprises: a method for forming a dual cigarette pack having a spacer therebetween, the method comprising: delivering a first cigarette pack to a first position of an assembly station; transporting said first cigarette pack from said first position to a second position of said assembly station; applying a spacer upon said first cigarette pack at said second position; delivering a second cigarette pack to a third position of said assembly station; and, transporting said first cigarette pack having said spacer thereupon to said third position, said first cigarette pack having a spacer applied thereupon being transported beneath said second cigarette pack already delivered to said third position, thereby creating a dual cigarette pack having a spacer therebetween.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

For reference, a cigarette pack has width, height, and thickness. Normally, twenty standard-sized cigarettes are packed in three rows comprising, in parallel, seven, six, and seven cigarettes, respectively. Therefore, the width of a cigarette pack is approximately the combined diameter of seven cigarettes; the height of a cigarette pack is approximately the length of the cigarette; and, the thickness of a cigarette pack is roughly the combined diameter of three cigarettes. These terms are defined for pack orientation only.

Figure 1:
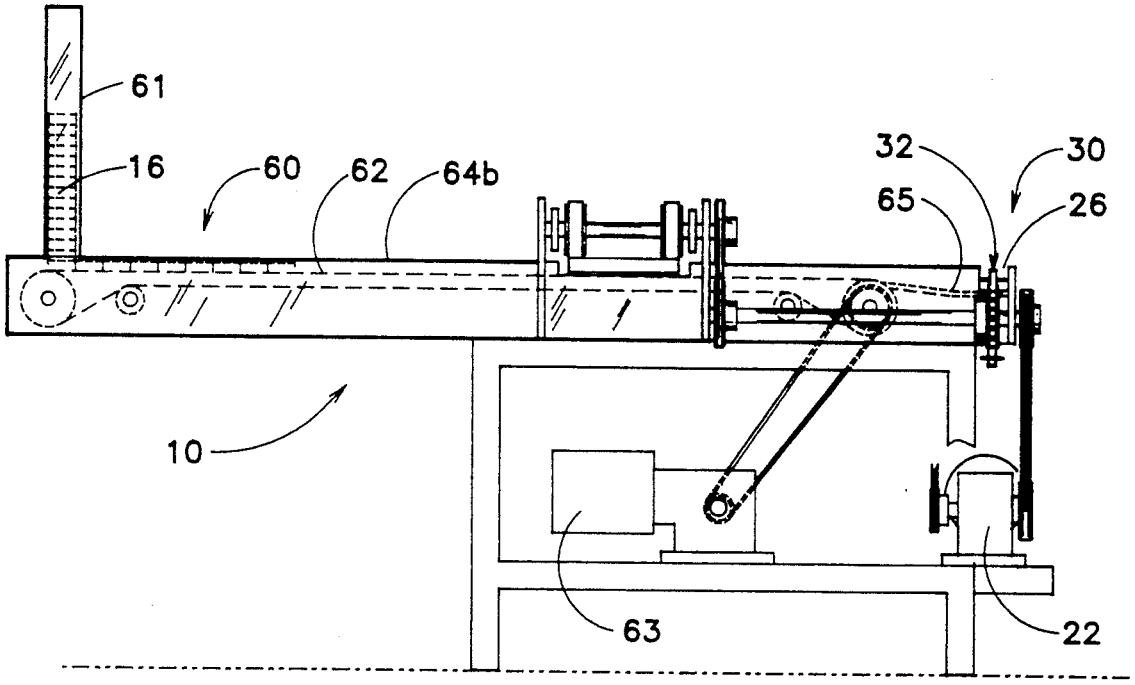
FIG. 1 is a front view of one apparatus embodied in the present invention.
Figure 2:
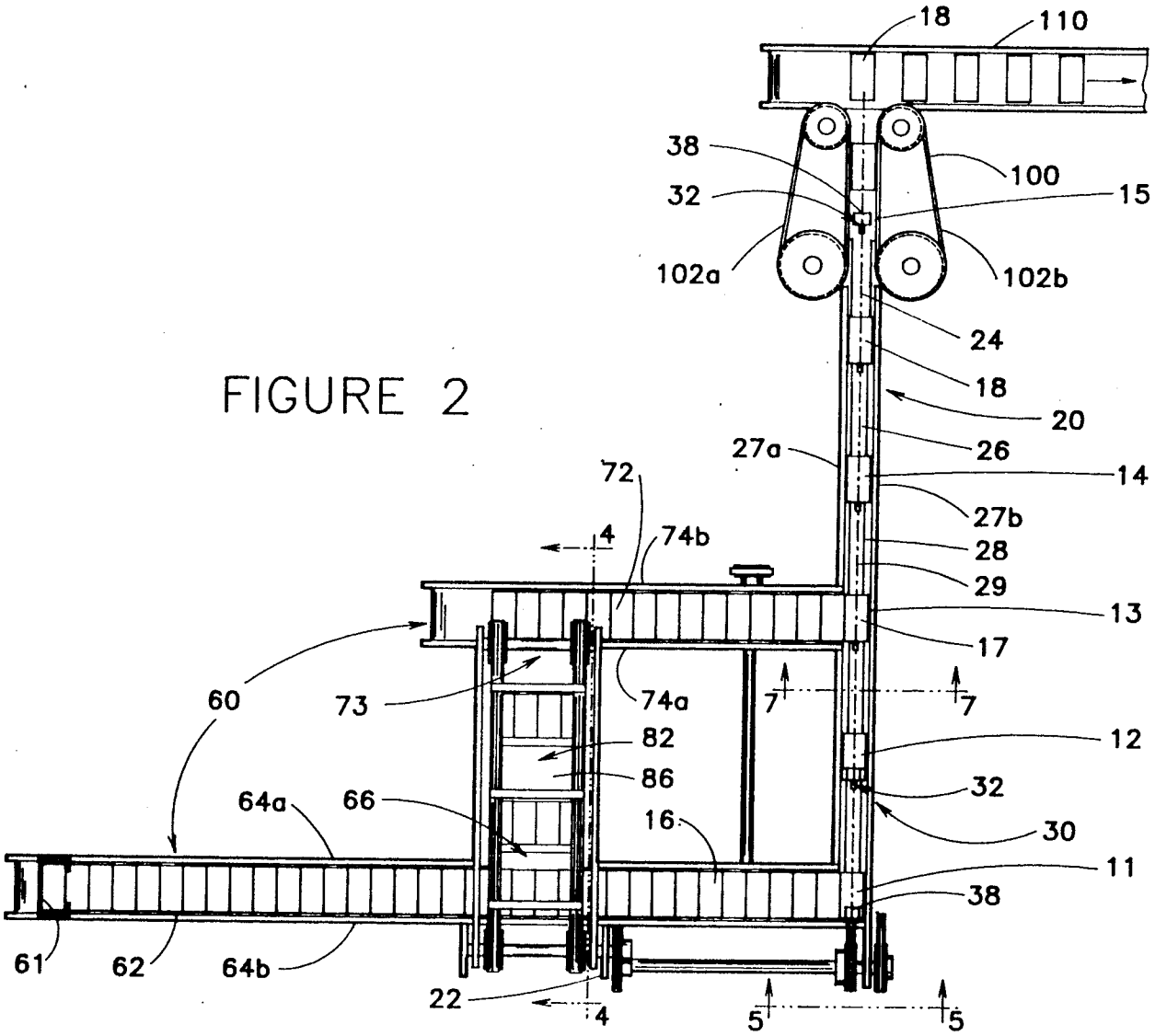
FIG. 2 is a top view of the apparatus of FIG. 1.
Figure 3:
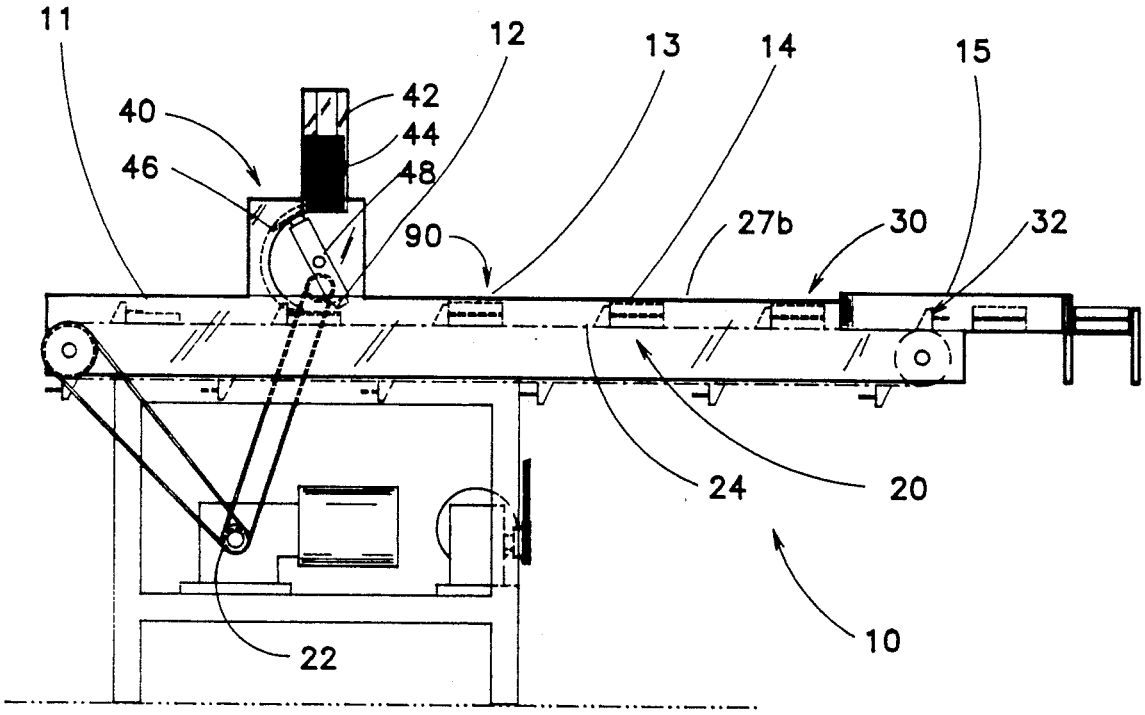
FIG. 3 is a side view of the apparatus of FIG. 1 having a means to place spacers on cigarette packs.

With reference to FIGS. 1–3, an apparatus 10 is shown which includes an assembly station 20. The assembly station 20 is provided with five operating positions, the first through fifth positions being identified by the numerals 11–15, respectively, for receiving packs of cigarettes 16, for insertion of spacers 44 between two stacked packs of cigarettes 16, and a package accelerating means 100. The assembly station 20 includes a means to transport cigarette packs through the assembly station, shown comprising a continuous single chain conveyor 24 having a chain drive means, shown generally as motor 22 and a cigarette pack trough 26. Trough 26 is provided with opposing sides **27*a*, 27*b* and a bottom 28. Bottom 28 has a center slot 29 to receive chain 24 therein. Side 27*a* is open at the first and third positions, identified by the numerals 11 and 13, respectively, of assembly station 20 for receiving packs of cigarettes 16. Sides 27*a* and 27*b* are also open at the fifth position 15**.

Means to move cigarette packs 16 along the trough 26 is identified by the numeral 30. In the preferred embodiment, lug pushers 32 connected to chain 24 are shown as the means to move the packs 16 along the trough 26.

Means to feed cigarette packs 16 to the first and third positions, 11 and 13, respectively, of assembly station 20 is denoted by the numeral 60. While many methods can be used to deliver cigarette packs to these two positions 11 and 13 of assembly station 20, one preferred embodiment shows cigarette packs 16 coming from a single source and being delivered through chute 61 to a first continuous belt conveyor 62. Conveyor 62 provides a continuous stream of cigarette packs 16 to the first position 11 of assembly station 20, as will be explained in greater detail with FIG. 5. Conveyor 62 is driven by appropriate drive means, exemplified by motor 63. Conveyor 62 is trough shaped, having two sides **64*a*, 64*b* which ensure proper alignment of the cigarette packs 16. The side 64*a* is open at the location identified by the numeral 66 where an index conveyor 82 removes packs 16 therefrom to feed a second continuous belt conveyor 72**.

Second continuous belt conveyor 72 receives, generally, four packs of cigarettes 16 at a time and delivers cigarette packs 16 to the third position 13 of assembly station 20. And, every time after four packs of cigarettes 16 have been moved from the first position 11 toward the second position 12 of assembly station 20, index conveyor 82 removes another four packs of cigarettes 16 from conveyor 62 and feeds them to conveyor 72. Index conveyor 82 is driven by chain drive means 22. Structure and operation of a preferred index conveyor 82 is further explained hereinafter.

Second continuous belt conveyor 72 is driven by drive means, usually a motor 63 which also drives conveyor 62. Conveyor 72 has two sides **74*a*, 74*b* which ensure proper alignment of the cigarette packs 16 thereon. The side 74*a* is provided with an opening 73 at the location where cigarette packs 16 are received from index conveyor 82. Conveyor 72 ensures a continuous supply of cigarette packs 16 at the third position 13 of assembly station 20**.

Figure 6:
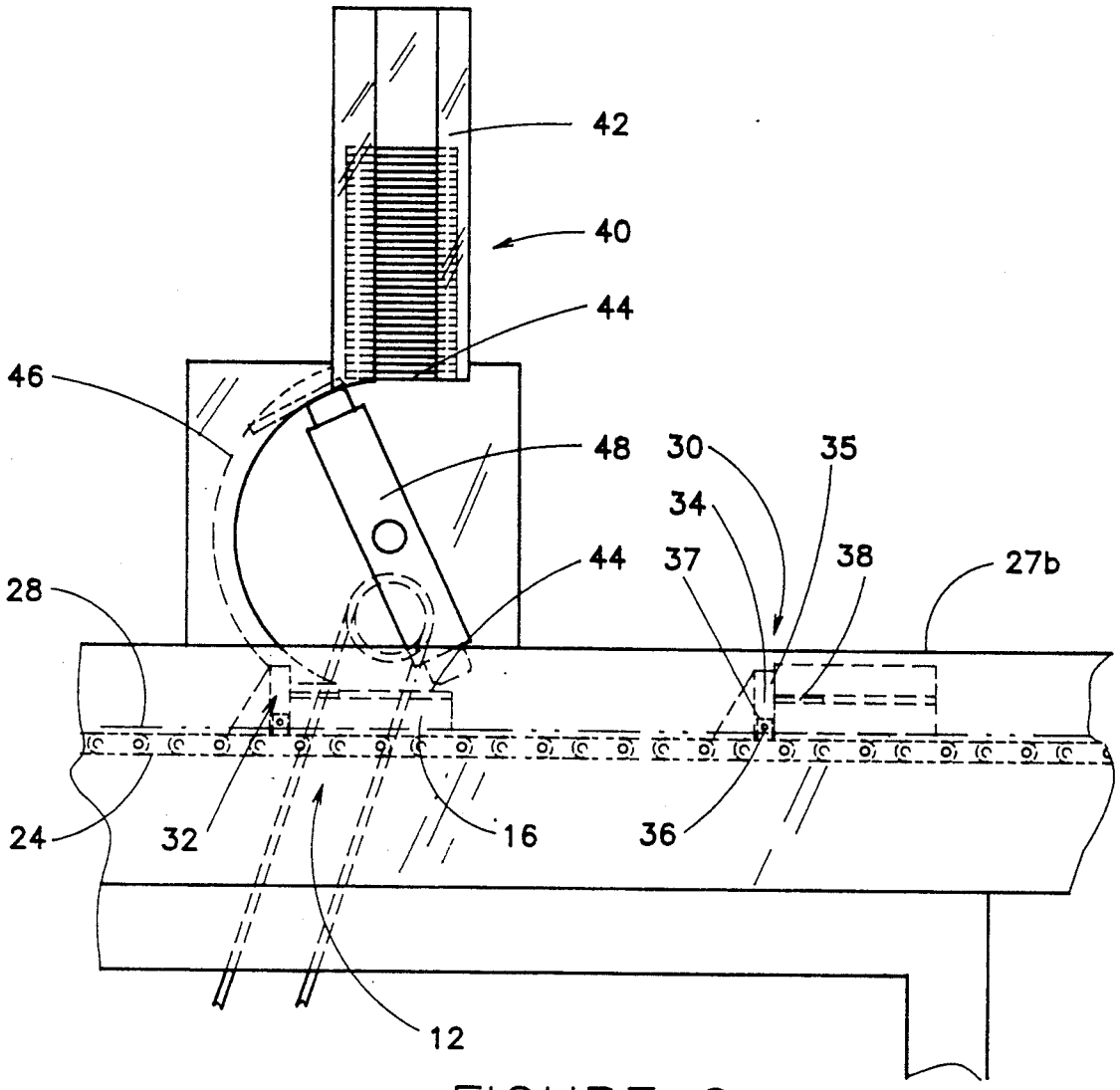
FIG. 6 is an enlarged side view of a portion of the apparatus of FIG. 3 at the location for a spacer being placed on a cigarette pack in said assembly station.

In FIG. 6 is shown the means 40 for placing a spacer 44 atop a pack of cigarettes 16 in the apparatus 10, the spacer 44 being placed on a cigarette pack 16 as it is being transported through the assembly station 20. The spacer 44 is fed at a second position 12 of the assembly station 20. A spacer chute 42 is provided and contains a plurality of spacers 44. As shown, means 40 to place spacer 44 atop a pack of cigarettes 16 is driven by chain drive means 22. An arc-shaped spacer guide slot 46 is provided for a rotating spacer transferror 48 to deliver spacers 44 from chute 42 to packs 16. As shown in the preferred embodiment, the rotating spacer transferror 48 is moving a spacer 44 along arc-shaped spacer guide slot 46 at the same speed as chain 24 is moving, therefore, the arc distance from chute 42 to pack 16 is the same as the distance between lug pushers 32. However, if it is desired that the arc distance and the distance between lug pushers be different, chain 24 and rotating spacer transferror 48 can easily be driven at different speeds based on the ratio of these distances. As is seen in FIG. 6, a spacer 44 is placed atop pack 16 abutting horizontal pack spacer element 38 of lug pusher 32, hereinafter described.

Figure 8:
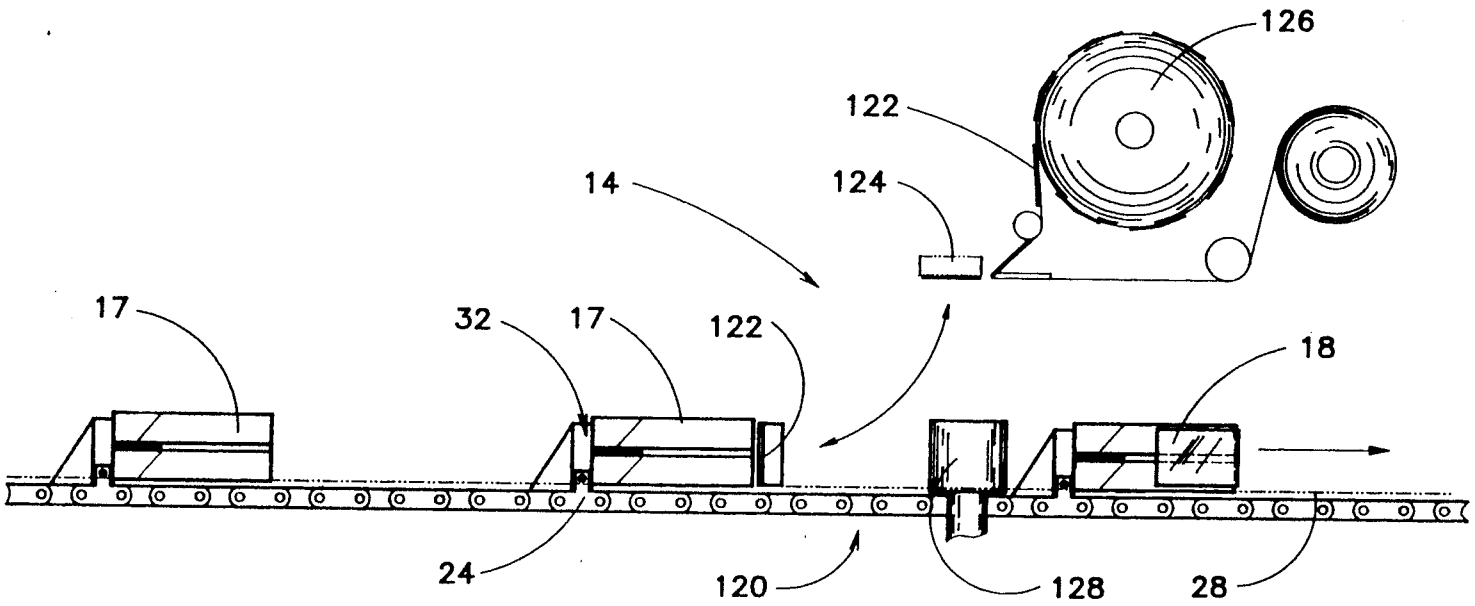
FIG. 8 is a schematic diagram of the label application area.

As shown in FIGS. 2 and 8, at a fourth position 14 of assembly station 20, a label applying device 120 is provided to apply labels 122 to the dual cigarette packs having a spacer therebetween, thereby creating a labeled dual pack. The unlabeled dual pack is identified by the numeral 17, while the labeled dual pack is identified by the numeral 18. The structure and operation of label applying device 12 and its interaction with assembly station 20 is explained hereinafter. Means 100 to accelerate labeled dual cigarette packs having a spacer therebetween 18 is shown at a fifth position 15 of assembly station 20. Means 100 for accelerating dual packs along assembly station 20, removing them from their respective lug pusher 32 and feeding the packs 18 to take away conveyor 110 for further processing is also described hereinafter.

Figure 4:
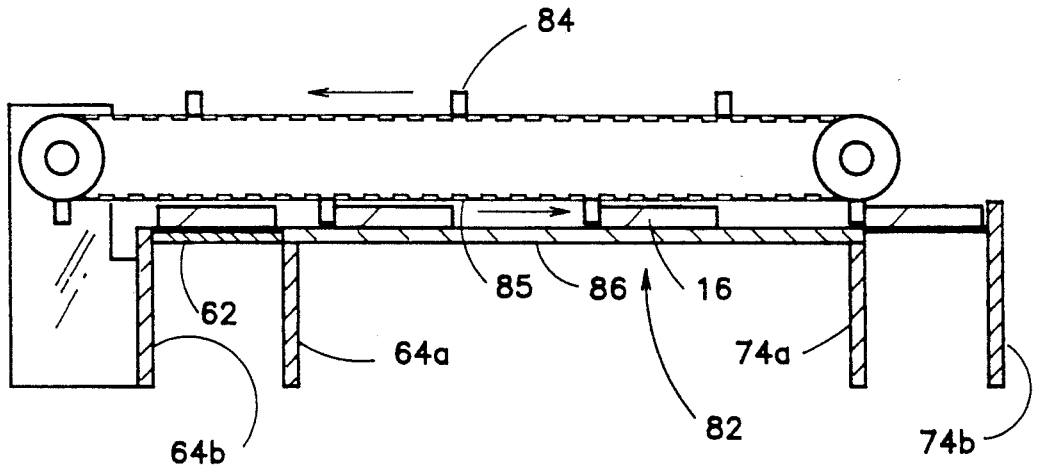
FIG. 4 is an enlarged side view of the index conveyor of FIG. 2.

FIG. 4 shows a side view of the index conveyor 82. Conveyor 82 is provided with indexing lugs 84 spaced apart so that when four packs of cigarettes 16 are transported through assembly station 20, conveyor 82 removes four packs 16 from conveyor 62 using the lugs 84 and supplies the packs 16 to conveyor 72. As best seen in FIG. 4, lugs 84 extend downwardly from an endless belt 85 of conveyor 82. As lugs 84 push the packs 16 therealong, packs 16 are guided to conveyor 72 by trough shaped slide 86.

Figure 5:
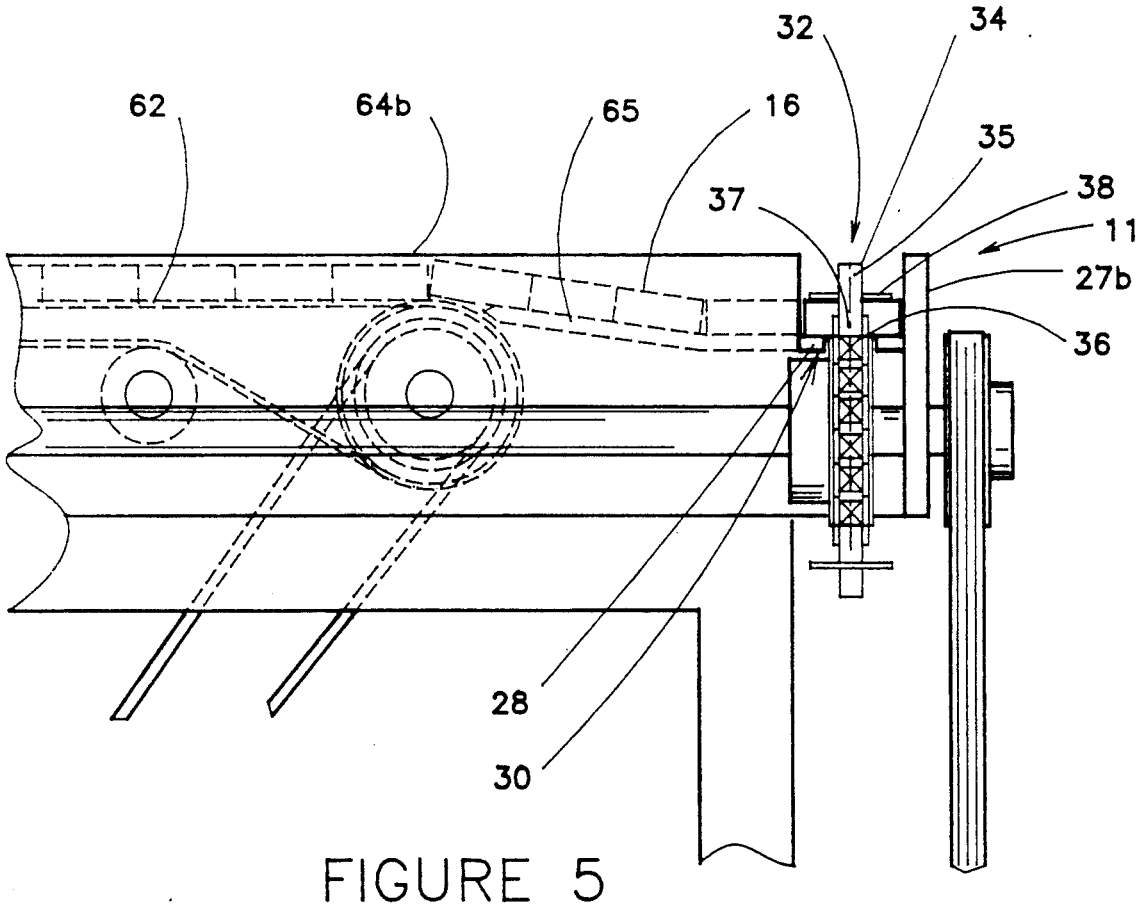
FIG. 5 is an enlarged side view of the apparatus of FIG. 2 at the location for feeding a first cigarette pack to an assembly station.

FIG. 5 shows greater detail of cigarette packs 16 being provided to the first position 11 of assembly station 20. The sides 64*a*, 64*b* of conveyor 62 extend to and inter-connect with the first position 11 opening of the assembly station 20 to ensure proper alignment of packs 16 into the assembly station 20. Conveyor 62 includes a discharge slide 65 at its downstream end to provide a continuous stream of packs 16 to assembly station 20. Slide 65 is provided to feed the packs 16 to their proper location at the first position 11, which is at the bottom 28 of trough 26. The continuous movement of conveyor 62 causes the replacement of packs 16 when they are transported away from first position 11. The side 27*a* of trough 26 is open at the first position 11 to receive the packs 16 from slide 65.

FIGS. 5 and 6 show transport means 30 to transport cigarette packs 12 through assembly station 20. In this embodiment, lug pushers 32 are connected to endless movable chain 24 to push cigarette packs 16 therealong. Lug pusher 32 includes a vertical post 34 having a top portion 35 and a bottom portion 37. Vertical post 34 is provided with connecting means 36 to connect to chain 24 at the bottom portion 37 of vertical post 34. Connecting means 36 is oriented so that vertical post 34 is perpendicular to chain 24 and the distance from the bottom 28 of trough 26 to the top of vertical post 34 is approximately the thickness of two cigarette packs 16. Connected intermediate of vertical post 34 is a horizontal pack spacer element 38. Pack spacer element 38 parallels the bottom 28 of trough 26 and is connected at a point on vertical post 34 where the distance from the bottom 28 of trough 26 to the spacer element 38 slightly exceeds the thickness of a pack of cigarettes. Spacer element 38 is generally rectangular-shaped and has approximately the same width as a pack of cigarettes, a thickness less than that of the spacer 44 to be received, and a length such that this length combined with the length of the spacer 44 to be received approximate the height of a pack of cigarettes.

Figure 7:
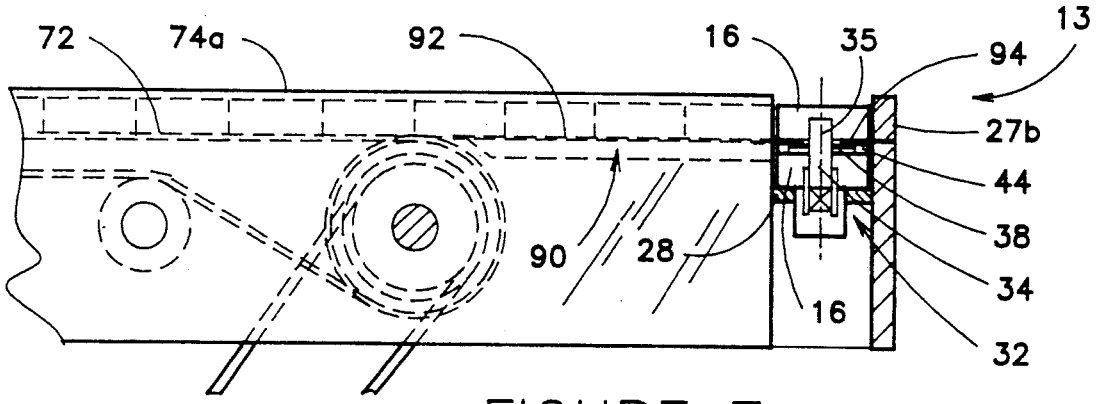
FIG. 7 is an enlarged side view of a portion of the apparatus of FIG. 1 at the location for feeding a second cigarette pack in said assembly station.

FIG. 7 shows a second cigarette pack 16 being placed on a cigarette pack 16 having a spacer 44 thereupon at the third position 13 of the assembly station 20. Upon receiving cigarette packs 16 from index conveyor 82, conveyor 72 provides packs 16 to the third position 13. The sides 74*a*, 74*b* of conveyor 72 extend to the third position 13 to ensure proper alignment of packs 16. Guide means 90 is provided to place a second pack 16 atop a first pack 16 with a spacer 44 thereupon. Guide means 90 includes guide members 92 and 94, wherein the guide members 92 and 94 project into the third position 13 of assembly station 20 and are spaced apart so that vertical post 34 can pass therebetween. Guide members 92 and 94 are spaced in trough 26 of assembly station 20 parallel to bottom 28 and are spaced from the bottom 28 so that a pack 16 having a spacer 44 thereupon being transported from the second position 12 will pass beneath guide members 92 and 94. The continuous movement of conveyor 72 pushes packs 16 across guide member 92 and onto guide member 94, so that when a first pack 16 having a spacer 44 thereupon is transported beneath the pack 16 at the third position 13, the top portion 35 of vertical post 34 of lug pusher 32 takes the now created dual pack 17 on toward the fourth position 14, and a new pack 16 is pushed into place at the third position 13 to await the next lug pusher 32. Side 27*a* of trough 26 is open at the third position 13 of assembly station 20 to receive the packs 16 being delivered by conveyor 72.

Figure 9:
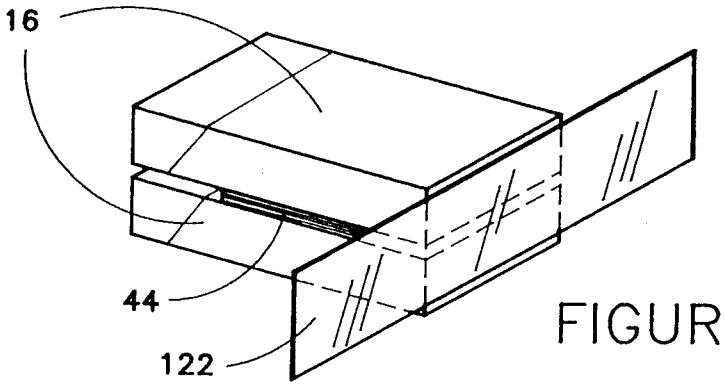
FIG. 9 is a perspective view of a label applied to two packs of cigarettes having a spacer therebetween.

FIG. 8 shows a diagram of the label 122 application area at the fourth position 14 of the assembly station 20. FIG. 9 depicts one method for applying a label 122 to two packs of cigarettes 16 having a spacer 44 therebetween. Preferably, the label applying means 120 is a commercially available label applicator. For example, the label 122 could be a self-adhesive label or could be secured with an adhesive, such as a hot melt or cold setting adhesive. Thus, the adhesive can be preapplied or applied at the fourth position 14 of assembly station 20. In one preferred operation, a rotating vacuum block or pad 124 picks up a label 122 from a supply roll 126 and places it in a position in the path of the dual packs 17. Chain conveyor 24 then brings the packs 17 into contact with the adhesive side of the label 122. The label 122 adheres to the ends of the packs 17. The chain conveyor 24 then pushes the packs 17 between wipe-down rollers 128, one on each side of the packs, to secure the label 122 thereon, thereby forming labeled dual packs 18.

As was previously disclosed and shown in FIG. 2, the assembly station 20 next moves the labeled dual packs 18 to a fifth position 15 where accelerating means 100 accelerates the packs 18 for delivery to take-away conveyor 110. As shown in FIG. 2, accelerating means 100 is shown including a pair of continuous belts 102*a* and 102*b*, which are placed on opposite sides of trough 26. Continuous belts 102*a* and 102*b* are in alignment with sides 27*a* and 27*b*, respectively. The downstream terminating end of side 27*a* is juxtaposed to the upstream end of belt 102*a* and the downstream terminating end of side 27*b* is juxtaposed to the upstream end of belt 102*b*. Belts 102 move at a speed greater than that of chain 24. Labeled dual packs 18 engage belts 102*a* and 102*b* and are moved at a speed greater than the movement of chain 24. This pulls packs 18 forward and disengages them from their respective lug pusher 32, and, in particular, spaces packs 18 apart from their respective horizontal pack spacer element 38. Packs 18 transfer to take-away conveyor 110 and respective lug pusher 32 is returned to the first position 11 of assembly station 20.

The foregoing detailed description is given primarily for clearness of understanding and no unnecessary limitations are to be understood therefrom for modifications can be made by those skilled in the art upon reading this disclosure and may be made without departing from the spirit of the invention and scope of the appended claims.

What is claimed is:

1. An apparatus for manufacturing dual cigarette packs having a spacer therebetween, comprising:

a. an assembly station to receive sequentially in stacked relationship a first pack of cigarettes, a spacer, and a second pack of cigarettes, said assembly station including means to transport said cigarette packs through said assembly station;

b. means to feed cigarette packs at first and third positions along said assembly station;

c. means to place a spacer on said first pack of cigarettes at a second position of said assembly station, said second position being located between said first and third positions of said assembly station;

d. means to place said second pack of cigarettes onto said spacer at said third position of said assembly station, thereby creating a dual cigarette pack having a spacer therebetween;

e. means to apply a label to said dual cigarette pack, said label securing said dual cigarette pack; and f. means to accelerate said secured dual cigarette pack and a take-away conveyor, wherein said means to transport said cigarette packs through said assembly station transports said secured dual cigarette pack at a first speed and said means to accelerate said secured dual cigarette packs transports said secured dual cigarette pack at a second upped greater than said first speed, thereby transferring said dual cigarette pack from said assembly station to said take-away conveyor.

2. An apparatus for manufacturing dual cigarette packs having a spacer therebetween, comprising:

a. an assembly station to receive sequentially in stacked relationship a first pack of cigarettes, a spacer, and a second pack of cigarettes, said assembly station including means to transport said cigarette packs through said assembly station;

b. means to feed cigarette packs at first and third positions along said assembly station;

c. means to place a spacer on said first pack of cigarettes at a second position of said assembly station, said second position being located between said first and third positions of said assembly station;

d. means to place said second pack of cigarettes onto said spacer at said third position of said assembly station, thereby creating a dual cigarette pack having a spacer therebetween;

e. said means to transport said cigarette packs through said assembly station comprises: a continuous chain conveyor; a chain drive means connected to said chain; at least one lug pusher, said at least one lug pusher connected to said chain; and a cigarette pack trough, said trough having two sides and a bottom, one of said side open at said first and said third position of said assembly station to receive cigarette packs, and said bottom of said trough having a center slot therein, said center slot including said chain therein.

3. The apparatus of claim 2, wherein said at least one lug pusher comprises: a vertical post having a top and a bottom; means to connect said chain to said bottom of said vertical post, said vertical post being perpendicular to said chain, said top of said vertical post being a distance approximating the thickness of two cigarette packs from said bottom of said cigarette pack trough; and a rectangular-shaped horizontal pack spacer connected to said vertical post at a location on said vertical post which at least the thickness of one cigarette pack from said bottom of said cigarette pack trough, said horizontal pack spacer being parallel to said bottom of said cigarette pack trough.

4. The apparatus of claim 3, further comprising: a plurality of lug pushers, said plurality of lug pushers being connected to said chain at locations which are equidistant from each other.

5. The apparatus of claim 4, wherein said means to feed cigarette packs at first and third positions along said assembly station comprises: a first continuous belt conveyor for providing cigarette packs to said first position; a chute for providing cigarette packs to said first continuous belt conveyor; a second continuous belt conveyor for providing cigarette packs to said third position; an index conveyor, said index conveyor removing cigarette packs from said first continuous belt conveyor and providing said cigarette packs to said second continuous belt conveyor, said index conveyor being driven by said chain drive means of said continuous single chain conveyor; a drive means for said first and said second continuous belt conveyors; said first continuous belt conveyor having sides for guiding said cigarette packs, one of said sides being open where said index conveyor removes said cigarette packs; and, said second continuous belt conveyor having sides for guiding said cigarette packs, one of said sides being open where said cigarette packs are received from said index conveyor.

6. The apparatus of claim 5, further comprising: a slide for providing cigarette packs from said first continuous belt conveyor to said first position of said assembly station, said slide being aligned to provide cigarette packs individually onto said bottom of said cigarette pack trough of said means to transport said cigarette packs through said assembly station, wherein one of said lug pushers will transport said individual pack along said bottom of said cigarette trough beneath said horizontal pack spacer of said lug pusher.

7. The apparatus of claim 4, wherein said means to place a spacer on said cigarette packs at a second position of said assembly station comprises: a spacer chute containing a plurality of spacers; an arc shaped spacer guide slot, said arc shaped spacer guide slot having an arc distance equal to the distance between said equidistant lug pushers; and a rotating spacer transferror, said rotating spacer transferror being driven by said chain drive means; wherein said rotating spacer transferror places one of said spacers upon said cigarette pack being transported by one of said lug pushers, said spacer abutting said horizontal pack spacer of said lug pusher.

8. The apparatus of claim 5, wherein said means to place cigarette packs onto said spacer at said third position of said assembly station further comprises: a pair of guides having a space therebetween, each of said guides being inserted into one of said sides of said cigarette pack trough parallel to said bottom of said cigarette pack trough, said guides being inserted at a location of said cigarette pack trough where one of said individual cigarette packs having spacer thereupon being transported by one of said lug pushers along said bottom of said cigarette pack trough will pass beneath said guides, said guides being spaced apart enough to permit said vertical posts of said lug pushers to freely pass therebetween, said guides being inserted to provide cigarette packs individually from said second continuous belt conveyor to said cigarette pack trough, wherein one of said vertical posts of said lug pushers will transport said individual pack along said cigarette trough atop said individual pack having a spacer thereupon.

9. A method for forming a dual cigarette pack having a spacer therebetween, the method comprising:

a. delivering a first cigarette pack to a first position of an assembly station;

b. transporting said first cigarette pack from said first position to a second position of said assembly station;

c. applying a spacer upon said first cigarette pack at said second position;

d. delivering a second cigarette pack to a third position of said assembly station;

e. transporting said first cigarette pack having a spacer thereupon to said third position, said cigarette pack having a spacer applied thereupon being transported beneath said second cigarette pack already delivered to said third position, thereby creating a dual cigarette pack having a spacer therebetween;

f. transporting said dual cigarette pack having a spacer therebetween from said third position to a location to receive a label;

g. applying a label to said dual cigarette packs, thereby creating a secured dual cigarette pack having a spacer therebetween;

h. transporting said secured dual cigarette packs having a spacer therebetween from said location to receive a label to an acceleration location;

i. accelerating said secured dual cigarette packs at said acceleration location; and j. transferring said secured dual cigarette packs having been accelerated to a take-away conveyor.

10. The method of claim 9, wherein said first and said second cigarette packs are obtained from a single source.

* * * * *

UNITED STATES PATENT AND TRADEMARK OFFICE

CERTIFICATE OF CORRECTION

PATENT NO. : 5,214,901
DATED : June 1, 1993
INVENTOR(S) : Kenneth M. Milliner,

It is certified that error appears in the above-indentified patent and that said Letters Patent is hereby corrected as shown below:

Column 1 Line 36 "s" should be ---so---.

Column 1, line 56, "belt" 1st occurrence), should be --belts--.

Column 1 Line 65 "then" should be ---them---

Column 2, line 1, "tip" should be --top--

Column 2 Line 4 "for" should be ---from---

Column 2 Line 7 "as" should be ---so---

Column 4 Line 56 label applying device "12" should be ---120---

Column 7 Line 13 "upped" should be ---speed---

Column 7 Line 40 "side should be ---sides---

Column 8 Line 45 insert ---a--- after "having", before "spacer"

Signed and Sealed this

Sixteenth Day of August, 1994

Bruce Lehman

*Attest:*

BRUCE LEHMAN

*Attesting Officer*

*Commissioner of Patents and Trademarks*